United States Patent [19]

Anderson et al.

[11] Patent Number: 4,727,668

[45] Date of Patent: Mar. 1, 1988

[54] CODED SURVEILLANCE MARKER WITH IMPROVED BIASING

[75] Inventors: Philip M. Anderson, Madison; Ronald K. Reich, Florham Park, both of N.J.

[73] Assignee: Allied Corporation, Morris Township, Morris County, N.J.

[21] Appl. No.: 772,215

[22] Filed: Sep. 3, 1985

[51] Int. Cl.[4] ..... G09F 3/02

[52] U.S. Cl. ..... 40/625; 40/20 R; 40/2 R

[58] Field of Search ..... 40/625, 2 R, 20 R; 292/306; 340/572

[56] References Cited

U.S. PATENT DOCUMENTS 3,215,150 5/1966 Sedgwick ..... 40/625
3,680,236 8/1972 Deal et al. ..... 40/630
4,417,413 11/1983 Hoppe et al. ..... 40/625
4,512,096 4/1985 Heidecker ..... 40/625

*Primary Examiner*—Gene Mancene
*Assistant Examiner*—Wenceslao J. Contreras
*Attorney, Agent, or Firm*—Ernest D. Buff; Gerhard H. Fuchs

[57] ABSTRACT

A surveillance marker is provided for utilization in antipilferage and anticounterfeiting systems. The marker includes a housing formed of barium ferrite impregnated plastic. Advantageously, the barium ferrite impregnated plastic housing provides a quasi-solenoidal dc magnetic bias field for activating one or more stacked ferromagnetic ribbons contained within the housing to produce an identifiable signal in response to an applied ac magnetic interrogation field.

7 Claims, 3 Drawing Figures

CODED SURVEILLANCE MARKER WITH IMPROVED BIASING

TECHNICAL FIELD

This invention relates to surveillance markers for utilization in anti-pilferage and anticounterfeiting systems. More particularly, the invention provides a surveillance marker with improved quasi-solenoidal biasing allowing the stacking of one or more signal producing ferromagnetic ribbons within a single marker.

DESCRIPTION OF PRIOR ART

Article theft from retail stores and public institutions such as libraries, is a serious problem. The cost of replacing stolen articles and the impairment of services rendered by institutions exceeds some six billion dollars annually.

Counterfeiting of name brand goods is an additional problem faced by manufacturers world wide. A recent study by the U.S. International Trade Commission indicates that counterfeiting of this type is presently costing American businesses alone up to eight billion dollars in lost sales annually. Still more startling is the fact that the theft and counterfeiting problems are increasing.

In order to combat the theft and counterfeiting menace, technologies have been developed for placing an identifiable marker or tag on the name brand good or article to be identified or protected. Of course, the markers themselves must be relatively inexpensive to produce while providing a reliable and readily identifiable signal.

An example of such a tagging or marking system is found in co-pending U.S. patent application Ser. No. 373,061 filed Apr. 29, 1982, now U.S. Pat. No. 4,510,489 entitled "Surveillance System having Magnetomechanical Marker" and assigned to Allied Corporation, the assignee of the present invention. As described the marker includes a strip or ribbon of ferromagnetic material, preferably an amorphous metal strip adapted to be magnetically biased and thereby armed to resonate mechanically at a frequency within the frequency band of a magnetic interrogation field.

The magnetic interrogation field may, for example, be provided by a transmitting apparatus including a drive coil that is situated on one side of a passageway leading to an exit from the premises. A receiving apparatus including a receive coil is positioned at the opposite side of the passageway. The drive coil sweeps through a predefined spectrum at frequencies including the resonance frequency of the target ribbon of the marker.

As the drive or interrogation frequency passes through the resonance frequency of the marker ribbon, there is a distinctive increase in the voltage induced in the receive coil. This allows simple and accurate marker detection even in the presence of other objects. Of course, detection indicates the article to which the marker is attached is being removed from the premises without authorization.

One of the problems with these advanced technologies is the limited number of available marker response frequencies. This is a particularly important consideration if target markers of this type are to be successfully adapted into product verification systems for combatting counterfeiting.

In anticounterfeiting systems it is desirable to have a large number of different marker codes available to prevent or discourage counterfeiting of the markers. One way we have discovered to do this is through the use of markers including multiple amorphous ribbons; each ribbon being designed to resonate mechanically in response to the interrogation field at a different identifiable frequency. Thus, it is necessary for each of the ribbon response signals to be present in order to indicate the authenticity of a name brand product.

It should be recognized that it is desirable to keep the markers small, even when including multiple ribbons, since the smaller the marker the less distracting the marker is from the appearance of the goods. It should also be recognized that small markers are less expensive to produce.

With these considerations in mind it is seen that it is often preferrable to stack the multiple ferromagnetic ribbons within a single marker. Stacking of ribbons within a marker, however, presents a problem with regard to the necessary biasing for activating the ribbons to provide the appropriate response signal. Specifically, target marker ribbons are presently magnetically biased using a strip of ferromagnetic or ferrimagnetic material having a high coercivity, such as vicalloy or Barium Ferrite impregnate plastic. One of the disadvantages of such strips is the fact that the bias field strength must be set by properly sizing the strip to the signal producing ribbon. Additionally the biasing strip may become strained during machining and sizing. This strain can cause the strip to produce a bias field that is not completely uniform and, therefore, not completely effective in arming the signal producing amorphous ribbon. Further, the resulting bias field shape from a single strip completely fails to provide the optimum biasing to stacked ribbons.

Therefore, a need is identified for an improved means of biasing ribbons in frequency coded surveillance markers. This is particularly true where the ribbons are stacked within the marker in order to reduce the overall size of the marker.

SUMMARY OF THE INVENTION

Accordingly, it is an object of the present invention to provide a highly efficient surveillance marker that is also less expensive to produce.

Another object of the present invention is to provide a surveillance marker exhibiting improved biasing characteristics, and is particularly adapted for accomodation of multiple ribbons in a single marker.

Still another object of the present invention is to provide a compact article surveillance marker with a built-in quasi-solenoidal biasing field thus eliminating the need for separate biasing strips placed within the marker.

Additional objects, advantages, and other novel features of the invention will be set forth in part in the description that follows and in part will become apparent to those skilled in the art upon examination of the following, or may be learned with the practice of the invention. The objects and advantages of the invention may be realized and attained by means of the instrumentalities and combinations particularly pointed out in the appended claims.

In accordance with these objects, the present invention provides a surveillance marker for utilization in antipilferage and anticounterfeiting systems. The marker includes a housing formed of plastic impregnated with a high coercivity magnetic powder, such as barium ferrite that advantageously provides a quasi-solenoidal magnetic biasing field to the marker. Such a field is particularly uniform and effective in activating one or more stacked ferromagnetic ribbons contained within the housing of the marker to produce an identifiable signal in response to an applied magnetic interrogation field.

Preferably, the ferromagnetic ribbons used to produce the response signals are magnetostrictive metal and are of an amorphous structure. Advantageously, marker ribbons of this type have high signal amplitude and a controllable signal signature that is not readily deactivated or reactivated by conditions other than those imposed by components of the system.

In accordance with the more limited aspects of the present invention the housing should include from 7%–25% barium ferrite by volume. Still more specifically, approximately 17%–21% barium ferrite by volume provides excellemnt results. For example, a marker housing composed of 17% barium ferrite and 83% plastic by volume provides a magnetic bias field that activates magnetostrictive ribbons of the marker to produce a response signal of high output voltage at or very near the precise frequency for which the ribbon is designed to respond.

BRIEF DESCRIPTION OF THE DRAWING

The invention will be more fully understood and further advantages will become apparent when reference is made to the following detailed description of the preferred embodiment of the invention and the accompanying drawing in which.

DETAILED DESCRIPTION OF THE INVENTION

Figure 1:
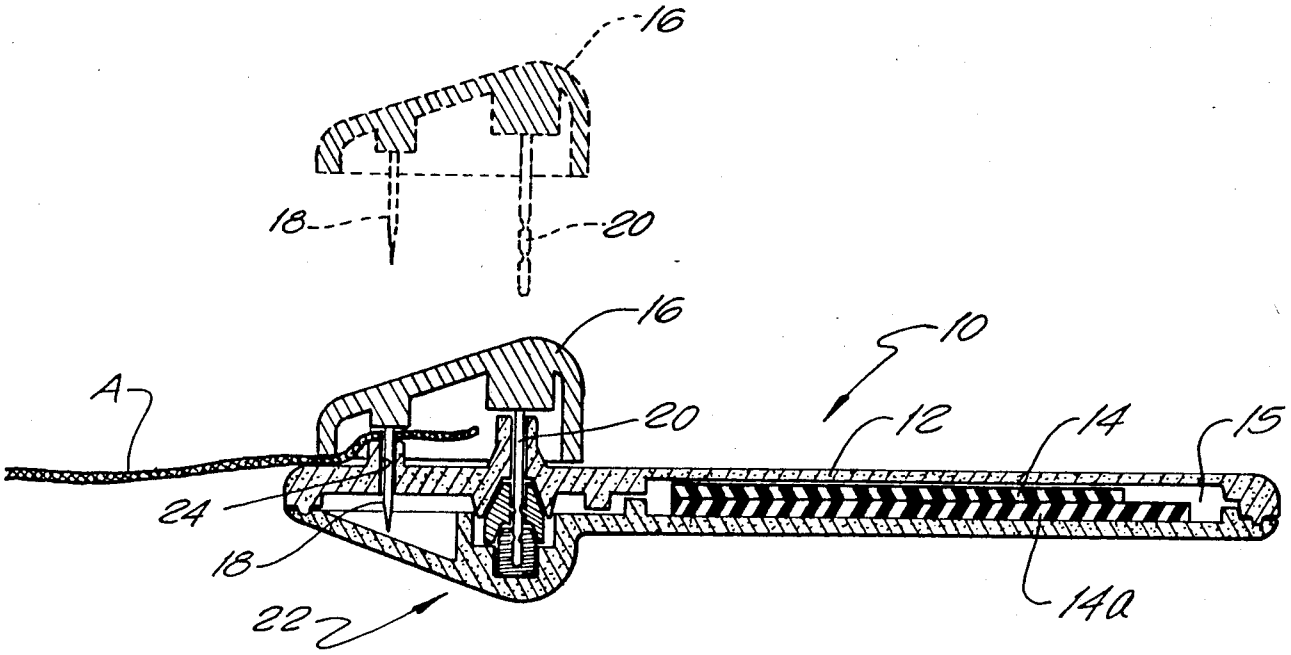
FIG. 1 is a cross-sectional view of the surveillance marker of the present invention.

Reference is now made to FIG. 1 showing the surveillance marker 10 of the present invention. The marker 10 includes a housing 12 containing, for example, two elongated ferromagnetic ribbons 14, 14*a* that exhibit magnetostrictive characteristics positioned in an interior cavity 15. Each ribbon 14, 14*a* is preferably a strip of amorphous metal adapted to be magnetically biased and thereby, armed to resonate mechanically at a standard or known frequency. The cavity 15 of the housing 12 is constructed so that each ribbon 14, 14*a* remains unrestrained and undamped in order to be free to vibrate.

The marker housing 12 is securely fastened to an article A by means of a pin assembly 16. As best shown, in dashed line in FIG. 1 the pin assembly 16 includes a dual pin fastening structure. The first pin 18 is smooth and the second pin 20 is grooved. The smooth pin 18 is pressed through the article A to which the marker 10 is to be fastened. As this is done the grooved pin 20 is inserted into the locking mechanism 22 in the housing 12 and the tip of the pin 18 after passing through the article A is received in housing aperture 24. This secures the pin assembly 16 and marker housing 12 together while preventing the article A from being slipped past the pin 18 (note full line position in FIG. 1). Advantageously, damage to the threads of the cloth articles characteristic of grooved pins is avoided while secure edge-to-edge locking action between the walls of the groove on the pin 20 and the locking mechanism 22 is provided. A more detailed explanation of the dual pin fastening structure is found in U.S. patent application, Ser. No. 737,318, filed May 23, 1985, entitled "Dual Pin Fastener", incorporated herein by reference.

As is known in the art, a direct current (dc) magnetic biasing field is necessary to activate the ribbons 14, 14*a* to provide an identifiable signal in response to an applied alternating current (ac) magnetic interrogation field. More specifically, when a dc bias field and an ac interrogation field are applied concurrently to the ribbons 14, 14*a* of the marker 10, energy is alternately stored and released by the ribbons with the frequency of the ac field. Mangetostrictive energy storage and release are maximal at the mechanical resonance frequency and minimal at the antiresonance frequency of the ribbon material. The resulting flux density changes in the ribbons 14, 14*a* relate to an increase in the effective magnetic permeability of each of the ribbons at their individual resonance frequency and a decrease at their individual anti-resonance frequency. This increase or decrease can then be observed as a change in the magnetic coupling between the drive and receive coils of, for example, an antipilferage system scanner (not shown). It should be recognized, however, that without the proper biasing, the identifiable response signal is not produced by the ribbon and the markers are undetectable.

In the present invention, the housing 12 performs a combined function of (1) containing and protecting the ferromagnetic signal producing ribbons 14, 14*a* from tampering and damage, as well as (2) providing the necessary ribbon biasing. In particular, the housing 12 is formed of hard plastic, such as ABS, impregnated with a ferrimagnetic powder of higher coercivity than the ribbons. Thus, the housing is suitable for providing the required dc magnetic biasing field.

In the specific embodiment of the invention being described, barium-ferrite powder is used. The barium-ferrite powder is mixed with the molten plastic. The molten composition is then injected into a mold to form the housing. Barium-ferrite powder has coercive fields of greater than 1,000 Oe. This is approximately 100 times greater than Vicalloy as used for biasing in the past. Advantageously, such increased coercivity virtually eliminates any possibility of the accidental or shoplifter promoted demagnetization of the marker that would render it ineffective as a signal producer.

The quantity of barium-ferrite powder in the housing defines the dc bias field strength. Tests have shown that a housing of from 7%–25% barium-ferrite by volume provides markers 10 with excellent frequency reponse ($f_r$) and a high level voltage output ($v_{out}$) providing a clear signal for utilization in an antipilferage system.

Figure 2:
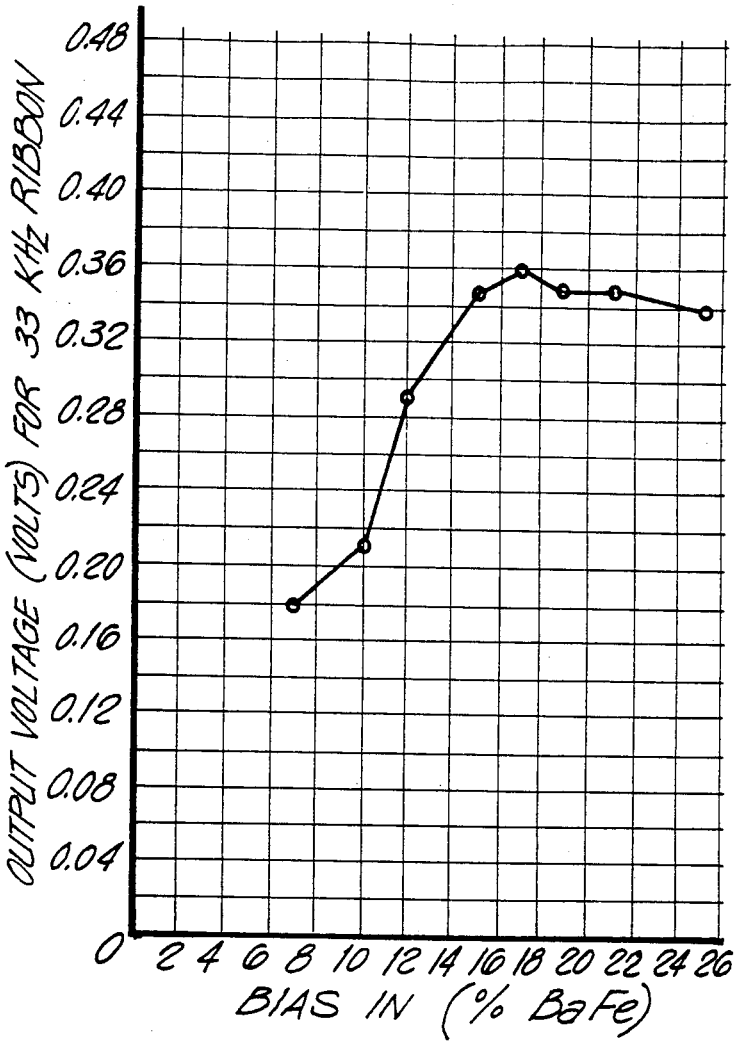
FIG. 2 is a graph showing the relation between the percentage of barium ferrite powder in the plastic housing by volume and the output voltage of the response signal from a 33 kHz marker ribbon.
Figure 3:
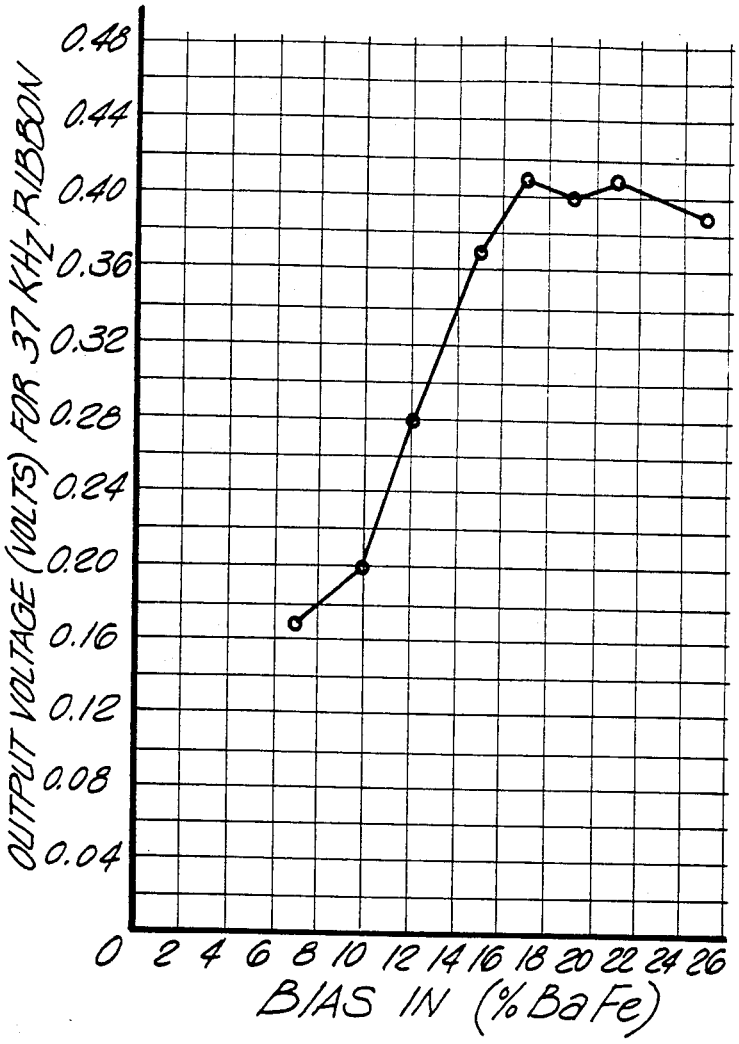
FIG. 3 is a graph similar to FIG. 2 showing the identical relation for a 37 kHz ribbon.

As shown in FIGS. 2 and 3 as well as in the table below, over this range of barium-ferrite concentration, frequency response ($f_r$) for a ribbon designed to resonate at 33 kHz ranged from 32.90 kHz to 33.2 kHz. For the same concentration ranges, the output voltage ($v_{out}$) of the response signal ranged from 0.18 to 0.36 volts. Similar results were found for a ribbon designed to resonate at 37 kHz. For such a ribbon the frequency response ($f_r$) ranged from 36.95 to 37.15 kHz and the output voltage ($v_{out}$) from 0.17 to 0.41 volts.

SUMMARY OF RESULTS RELATIVE TO THE VARIOUS "BaFe" CONCENTRATIONS

| "BaFe" | 33 kHz | | 37 kHz | |
|---|---|---|---|---|
| Concentration | $f_r$ | $v_{out}$ | $f_f$ | $v_{out}$ |
| 7% | 32.95 | 0.18 | 37.05 | 0.17 |
| 10% | 33.05 | 0.21 | 37.10 | 0.20 |
| 12% | 32.90 | 0.29 | 37.0 | 0.28 |
| 15% | 33.20 | 0.35 | 37.15 | 0.37 |
| 17% | 33.10 | 0.36 | 37.0 | 0.41 |
| 19% | 33.05 | 0.35 | 37.0 | 0.40 |
| 21% | 33.05 | 0.35 | 37.0 | 0.41 |
| 25% | 33.0 | 0.33 | 36.95 | 0.39 |

It, of course, should also be appreciated from viewing the above table that a barium-ferrite concentration ranging from 17% to 21% provided the best results. A housing of 17% barium-ferrite and 83% plastic shows the optimum combination of frequency response and output voltage.

As a further advantage of the present invention, the barium-ferrite impregnated housing 12 completely surrounds the ribbon containing cavity 15. Thus, the housing 12 provides a uniform quasi-solenoidal dc magnetic bias field effective in activating multiple ferromagnetic ribbons 14, 14*a* even when stacked together. This represents an important advance in the art over the Vicalloy strip formerly used for biasing. Disadvantageously, these strips had to be specially sized to provide the proper biasing field. Further, a single strip fails to provide a proper field to perform the biasing function when the magnetostrictive ribbons were stacked together. Thus, where multiribbon markers were employed, the ribbons had to be placed side-by-side with their own biasing strip; i.e. marker ribbons stacked with intermittent Vicalloy biasing layers. Consequently, the multiribbon markers of the prior art had to be made larger to accomodate the necessary ribbon placement. Further, prior art markers were costly since a biasing Vicalloy strip(s) has to be sized and provided for each magnetostrictive signal producing ribbon.

In summary, numerous benefits result from employing the concepts of the present invention. The marker 10 of the present invention advantageously provides internal biasing to one or more stacked ferromagnetic, magnetostrictive signal producing ribbons 14, 14*a* contained within the housing cavity 15. Since the desired quantity of barium-ferrite powder for biasing is mixed with the plastic and injection molded into the housing, there is no need to specifically size biasing strips and target marker manufacturing costs are greatly reduced.

The foregoing description of the present invention has been presented for purposes of illustration and description. It is not intended to be exhaustive or limit the invention to the precise form disclosed. Obvious modifications or variations are possible in light of the above teachings. The embodiment was chosen and described simply to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A surveillance marker for utilization in antipilferage, anticounterfeiting and like systems, comprising:

ferromagnetic signal producing means comprising at least one strip of magnetostrictive ferromagnetic material; and combined housing and biasing means for said signal producing means formed of plastic impregnated with ferrimagnetic or ferromagnetic powder of relatively high coercivity; said high coercivity powder providing a quasi-solenoidal dc magnetic bias field for activating said ferromagnetic signal producing means to produce an identifiable singal in response to an applied magnetic interrogation field.

2. The surveillance marker recited in claim 1, wherein said strip has an amorphous structure.

3. The surveillance marker recited in claim 1, wherein said ferrimagnetic powder of relatively high coercivity is barium ferrite.

4. The surveillance marker recited in claim 3, wherein said combined housing and biasing means is from 7%–25% barium ferrite by volume.

5. The surveillance marker recited in claim 3, wherein said combined housing and biasing means is approximately 15%–21% barium ferrite by volume.

6. The surveillance marker recited in claim 3, wherein said combined housing and biasing means is approximately 17% barium ferrite and 83% ABS plastic by volume.

7. The surveillance marker recited in claim 1, wherein said ferromagnetic signal producing means is multiple magnetostrictive strips of ferromagnetic material stacked together.

* * * * *